United States Patent [19]

Demukai

[11] 4,301,623

[45] Nov. 24, 1981

[54] SEMIAUTOMATIC SLIDING DOOR DEVICE WITH TENSION SPRING

[75] Inventor: Enzo Demukai, Higashi-Osaka, Japan

[73] Assignee: Nippon Door Check Mfg. Co., Ltd., Osaka, Japan

[21] Appl. No.: 100,530

[22] Filed: Dec. 5, 1979

[30] Foreign Application Priority Data

Dec. 11, 1978 [JP] Japan ..... 53-153301
Dec. 11, 1978 [JP] Japan ..... 53-170552
Jan. 10, 1979 [JP] Japan ..... 54-001906

[51] Int. Cl.[3] ..... E05D 15/06

[52] U.S. Cl. ..... 49/404; 16/78; 16/82; 188/267

[58] Field of Search ..... 49/404, 360; 188/267, 188/165; 310/93; 16/72, 77, 82, 83, DIG. 21, 78

[56] References Cited

U.S. PATENT DOCUMENTS 801,694 10/1905 Sheppard ..... 16/78
3,389,422 6/1968 Glenn ..... 16/78
3,579,003 5/1971 Gray ..... 310/93
3,723,795 3/1973 Baermann ..... 188/165 X
3,978,617 9/1976 Eventoff ..... 49/404
4,003,102 1/1977 Hawks et al. ..... 49/404 X

FOREIGN PATENT DOCUMENTS 12242 4/1901 Sweden ..... 16/72

*Primary Examiner*—Philip C. Kannan
*Attorney, Agent, or Firm*—Whittemore, Hulbert & Belknap

[57] ABSTRACT

A semiautomatic sliding door device comprising a sliding door, an outer framework slidably supporting the door for movement between the positions of 'open' and 'closed' and a driving device comprising a tension spring energizing the sliding door toward the 'closed' position, a connecting wire, and a guide wheel for guiding the wire. This device is equipped with a braking device comprising permanent magnets on the outer framework and a braking plate made of copper or aluminum sheets on the sliding door. Coiling said wire around the block in proper manner, the length of elongation of the tension spring can be reduced relative to the stroke of the sliding door.

13 Claims, 7 Drawing Figures

SEMIAUTOMATIC SLIDING DOOR DEVICE WITH TENSION SPRING

This invention relates to a semiautomatic sliding door device with a tension spring whose resilience is utilized for automatic closing of a door that has been opened by hand.

A door check (door closer) designed to automatically close a hinged door that has been manually opened, utilizing the resilience of a compression spring, is already known. Included among sliding doors are one adapted to be closed automatically by gravity, sliding on the inclined guide rail provided therefor, and another, also depending on gravity, sliding by a vertically movable weight provided on the outer framework encircling the door and connected to the body of the door. These gravity type doors are characterized by such problems as inadequacy of exactness and stability in performance when the weight is small and light as well as inconvenience, when the weight is large, due to largeness itself in addition to the great impact caused when the door is closed. As disclosed in the Japanese Published Examined Patent Application No. 27457/1977, there has been proposed a magnet type device in which magnets are provided on the outer framework and sliding door for energizing the door in the direction toward the 'closed' position, utilizing attraction and/or repulsion of magnets. However, this type requires a large number of magnets and accordingly great expense.

The object of this invention is to provide a semiautomatic sliding door device, free from such problems as exist in the conventional device, utilizing the tension spring which ensures exact and stabilized performance and is light in weight, simple in structure and inexpensive, not requiring wide space and being readily incorporated into an ordinary door.

For this purpose, the invention provides a semiautomatic sliding door device comprising a sliding door, an outer framework which slidably holds the sliding door between the positions of 'open' and 'closed', a tension spring provided on the sliding door or the outer framework, the one end of said tension spring fixed to one of two elements consisting of the sliding door and the outer framework whereas the other end is connected, through a wire, to the other element, and a guide wheel provided on at least one of the two elements for guiding the wire to prevent the wire and tension spring from interfering with the sliding door and the outer framework. This semiautomatic device is light in weight, simple in structure, and not in need of wide space thanks to the use of the coiled tension spring.

According to the preferred embodiment of this invention, the wire is caught by the hook means provided on the outer framework or the sliding door and said hook means comprises a plurality of hooks whose positions are different from each other, permitting the adjustment of a predetermined degree of tension.

Also, according to the preferred embodiment of this invention, the block means is constituted by a running block or duplex block around which the wire is halfway coiled. This system enables the degree of elongation of the spring to be a half or less of the stroke of the sliding door, resulting in the reduction of variation in the energizing force acting on the door between the positions of 'open' and 'closed', and giving a natural feeling without heaviness while opening the door.

Preferably, said tension spring is enclosed by a cylindrical body to ensure smooth elongation and contraction and, further preferably, the tension spring, block means, wire, and guide wheel are arranged in the cylindrical body to be made up into a unitary driving means.

According to another preferred embodiment of this invention, a braking magnet unit having a hollow space in the central portion thereof is installed on the outer framework and a braking plate is fixed to the sliding door so that said door passes through the hollow space of the magnet unit when sliding near the 'closed' position. Provision of a braking means consisting of the magnet unit and the braking plate enables automatic closing, without impact, of the sliding door which is subjected to braking by magnetic eddy current generated in said braking plate when this plate passes across the magnetic lines of force. Therefore, damage to the door and outer framework as well as abrasion thereof due to repeated sliding of the door are reduced.

A fixing means for fixing said braking plate to the sliding door is preferably constructed so as to be easily adjusted even after the sliding door is fitted in the outer framework. Then, the magnitude of the magnetic lines of force cut by the braking plate can be adjusted, enabling easy adjustment of the braking force. Further, it is preferable to make the braking plate positioned correctly and easily in the center of the hollow space of the magnet unit after the sliding door has been fitted in the outer framework with the braking plate made positionally adjustable in the horizontal direction.

Several other characteristics and effects of this invention will be readily understood from the following description of the preferred embodiments of this invention and annexed drawings.

Figure 1:
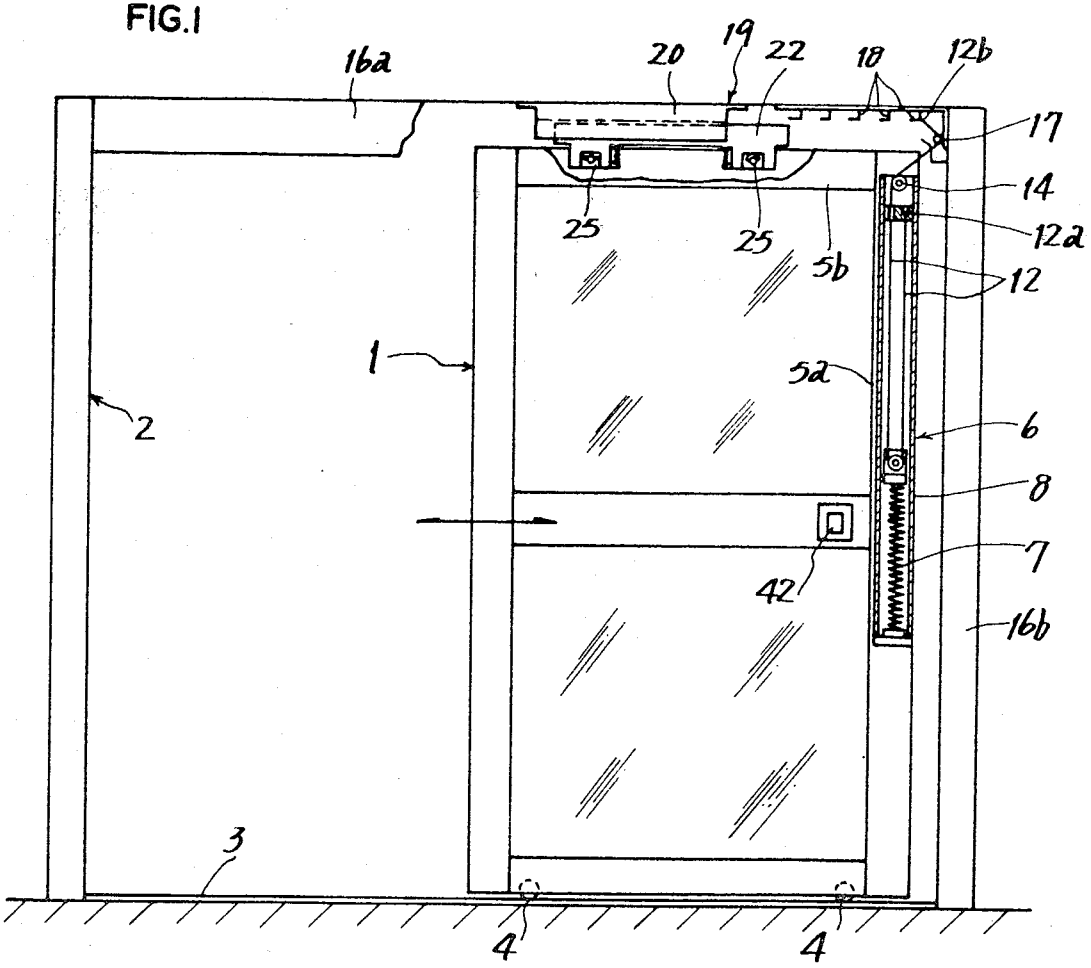
FIG. 1 is a partially sectional front elevation of an embodiment of this invention.
Figure 2:
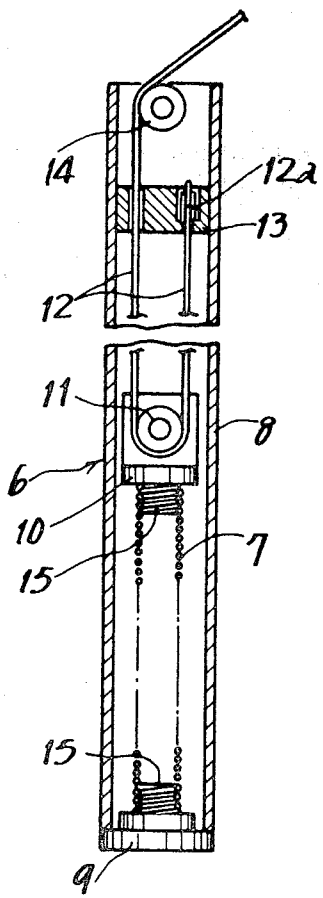
FIG. 2 is an enlarged vertical sectional view of the driving means of the embodiment shown in FIG. 1.

In FIG. 1 showing the sliding door device, the reference numeral 1 denotes the sliding door, 2 the outer framework which slidably holds said door between the positions of 'open' and 'closed', 3 the guide rail on which the sliding door 1 slides, and 4 the runner. Inside a stile 5*a* of the sliding door 1, is arranged the driving means 6 provided with a coiled tension spring 7 which energizes the sliding door 1 toward the 'closed' position of the door. This driving means 6 comprises, as shown in FIG. 2, a cylinder 8, said tension spring 7 inserted into the lower inner part of said cylinder 8, a fixing member 9 for fixing the bottom part of said tension spring to the lower end of said cylinder 8, setting member 10 to which the upper end of said tension spring is connected and a running block 11 is fixed, a wire 12 halfway coiled around the running block 11, a fixing member 13 provided on the upper part of the cylinder to fix the one end 12*a* of said wire to the cylinder 8, and a guide wheel 14 provided on the upper end of the cylinder 8 to guide the other end of said wire 12 in the direction from the upper end of the cylinder 8 to the outside. Said tension spring 7 is provided with the largest possible number of coils so as to reduce the load variation according to the degree of elongation and contraction thereof. Connection of the fixing member 9 and setting member 10 with the ends of spring 7 is provided by externally threaded studs 15 with which the ends of the tension spring 7 are engaged. Such connecting construction ensures easy and sure fixation of the tension spring 7 to the fixing member 9 and the setting member 10. Though the running block 11 with a single pulley only is used in the embodiment herein shown, a stationary block on the fixing member 13 may be used or the guide wheel 14 may be replaced by a stationary block with a plurlaity of pulleys, and, further, the running block 11 may be provided with a plurality of pulleys. Also, in the embodiment shown, though all of the various elements are set within the cylinder 8, they may be set independently from each other on the stile 5*a* of the door. The other end 12*b* of the wire 12 extended from the driving means 6 is caught by an optionally selected one of a plurality of hooks 18 provided at longitudinally spaced intervals on the internal wall of the top frame 16*a* of the outer framework 2 through the intermediate guide fitting 17 provided on the one end of the top frame 16*a*. The sliding door 1 can be slid correctly to the 'closed' position by such provision of the intermediate guide fitting 17 and the predetermined degree of energizing force can be adjusted by provision of a plurality of hooks 18.

Figure 3:
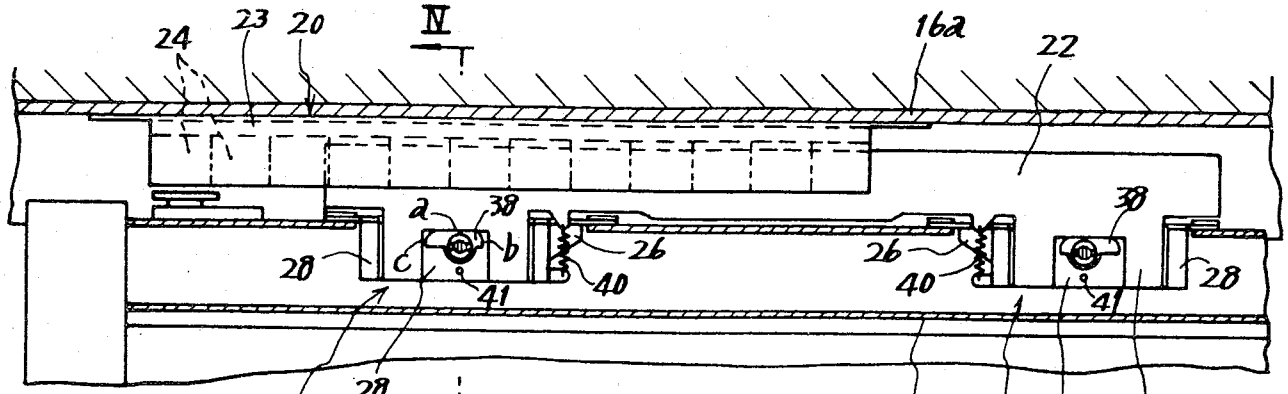
FIG. 3 is an enlarged longitudinal sectional view of the braking means of the embodiment shown in FIG. 1.
Figure 4:
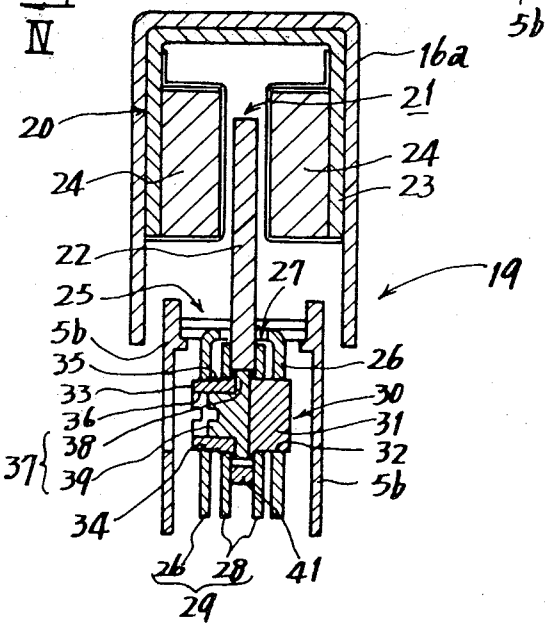
FIG. 4 is a sectional view thereof taken along the arrow line IV—IV of FIG. 3.

On said top frame 16*a* of the outer framework, is provided a braking magnet unit 20 having a hollow space 21 within the central portion thereof extending along the length of said frame 16*a;* on the upper end of the sliding door 1, is provided a braking plate 22 which passes through said hollow space when said door 1 slides. A braking means 19 which brakes the sliding door 1 in motion near the 'closed' position thereof is thus composed of this magnet unit 20 and braking plate 22. Referring to FIGS. 3 and 4, in this braking means 19, said magnet unit 20 comprises a plurality of pairs of small magnets 24 arranged on both opposing sides of the plates 23 bent in the shape of U in cross-section in such manner as to define a hollow space 21 between pairs of magnets 24, each magnet being so arranged as to be inverse to the adjacent one in polarity as well as to the one lying on the opposite side across the hollow space. Instead of an application of a large number of magnets 24, a pair of permanent magnet plates with poles inverse to each other in polarity which are arranged alternately in the longitudinal direction may be used, or a piece of cross-sectionally U-shaped permanent magnet may be used, these enabling easier assembling than that of the aforesaid manner. The braking plate 22 composed of a metallic sheet such as silve, copper, aluminum or the like is fixed to the top rail 5*b* of the sliding door 1 by the fixing means 25. The setting positions of magnet unit 20 and braking plate 22 are determined so that the braking plate 22 may pass through the hollow space 21 when the sliding door 1 slides near the 'closed' position thereof, and the length of these two parts is determined according to the most appropriate magnitude of braking force and the distance to bear the braking load. Said fixing means 25 consists of the setting piece 26 fixed to the inside surface of said top rail 5*b* and having a vertically extending hollow space 27 at the central portion thereof into which a part of the braking plate 22 is inserted; the supporting piece 28 being provided with a pair of supporting plates which support both sides of said braking plate 22 for movement in a vertical direction, the braking plate being disposed in the space 27 defined by said setting piece 26; and the supporting shaft unit 30 which supports said supporting piece 28 and braking plate 22 in the vertical direction. Said setting piece 26 and supporting piece 28 compose the supporting member means 29. The supporting shaft unit 30 consists of the 1st supporting shaft 31 whose one end engages with one of the supporting plates of the supporting piece 28 whereas the other end protrudes outward, being axially displaceably fitted in the horizontal holes 32 provided on the setting piece 26; and 2nd supporting shaft 33 in the shape of sleeve, wherein the one end thereof rotatably engages with the other supporting plate of the supporting piece 28 and the remaining part thereof is provided with a threaded part 35 to be engaged with the horizontal tapped hole 34 provided on the setting piece 26 in alignment with the aforesaid horizontal hole 32, and the cylindrical hole 36 is provided on the center thereof; and the cam shaft 37 provided with the plate cam 38 located between the one end of said 1st supporting shaft 31 and that of said 2nd supporting shaft 33 and further providing with shaft part 39 rotatably fitted in said cylindrical hole 36. Said plate cam 38 is provided with a plurality of contact parts a, b, and c at the periphery thereof, said contact parts being spaced from the axis of the shaft part 39 distances different from each other, and any one of these contact parts a, b, and c coming into contact with the edge of the braking plate 22 will determine a position of the plate 22 in the vertical direction. The reference numeral 40 denotes a spring interposed between the braking plate 22 and the setting piece 26 and pushing the braking plate 22 toward the outer periphery of the plate cam 38. The numeral 41 represents a pin which is provided between a pair of supporting plates of the support piece 28 and retains a rotational position of the cam shaft 37 by contact of any one of the stepped portions of the contact parts b or c with the pin 41, preventing further rotation of said shaft.

Next, a description will be made on the performance of this device. When the sliding door 1 is opened by applying a hand to the handle 42, the tension spring 7 is stretched upward by the wire 12 which is pulled upward through the guide wheel 14 and the block 11. The length of stretch of the spring is equal to a half of the stroke of the sliding door 1. When the sliding door 1 is released, the wire 12 is pulled downward by the resilience of the tension spring 7 through the block 11 and the guide wheel 14, and the wheel 14 fixed to the sliding door 1 is pulled in the direction toward the intermediate guide fitting 17 causing the sliding door 1 to be automatically closed. FIG. 1 shows a state of the sliding door 1 immediately before complete closing thereof. When the sliding door 1 is closed in such a way as described above, passage of the braking plate 22 fixed to the top rail 5*b* of the sliding door 1 through the hollow space 21 in the magnet unit 20 generates a magnetic eddy current in the braking plate 22, whereby a controlling magnetic brake is applied to the door immediately before complete closing thereof. Adjustment in the operation of this braking force is performed as follows:

Illustrations of FIGS. 3 and 4 show a state in which the bottom edge of the braking plate 22 is in contact with the contact part a and, therefore, the plate itself is in the lowest one of three positions, in which the overlapped area of the surfaces of said braking plate 22 and magnet unit 20 each being opposite, is minimized and the braking force is at a minimum. If the cam shaft 37 is turned counterclockwise to cause the contact part b to touch the bottom edge of the braking plate 22, the contact part b which is more distant from the axis of the cam shaft than the contact part a raises the braking plate 22 to the middle of three heights, whereby the degree of braking force is adjusted to the medium. On the other hand, if the cam shaft 37 is turned clockwise to cause the contact part c to touch the bottom edge of the braking plate 22, the contact part c which is more distant from the axis of cam shaft than the contact part b raises the braking plate 22 to the highest position of the three, whereby the degree of braking force is adjusted to the maximum. When the position of the braking plate 22 is required to be adjusted horizontally, upon turning the sleeve-shaped supporting shaft 33 clockwise or counterclockwise, this shaft 33 moves axially owing to screw-engagement of the threaded part 35 thereof with the tapped hole 34 of the setting piece 26 and is followed by the concurrent displacement of the supporting plate 28 movably engaged with this supporting shaft 33, and the braking plate 22 which is supported by this supporting piece 28, but limited to vertical movement only, moves in the horizontal direction. In this way, rotation of the sleeve-shaped supporting shaft 33 permits position adjustment of the braking plate 22 to the center of the hollow space 21 of the magnet unit. Accordingly, the braking plate 22 can readily be adjusted horizontally even after the sliding door 1 is fitted in the outer framework 2.

Although the construction as described above is intended to permit both the adjustment of height of the braking plate 22 and that of horizontal position, for adjustment of height only, the supporting means 29, i.e. setting piece 26 and supporting piece 28, can be integrated into one body and the supporting shaft unit 30, i.e. the 1st supporting shaft 31, and 2nd sleeve-shaped supporting shaft 33 and the cam shaft 37, can be integrated into one body as a shaft, and, for adjustment of horizontal position only, the cam shaft 37 can be omitted.

Figure 5:
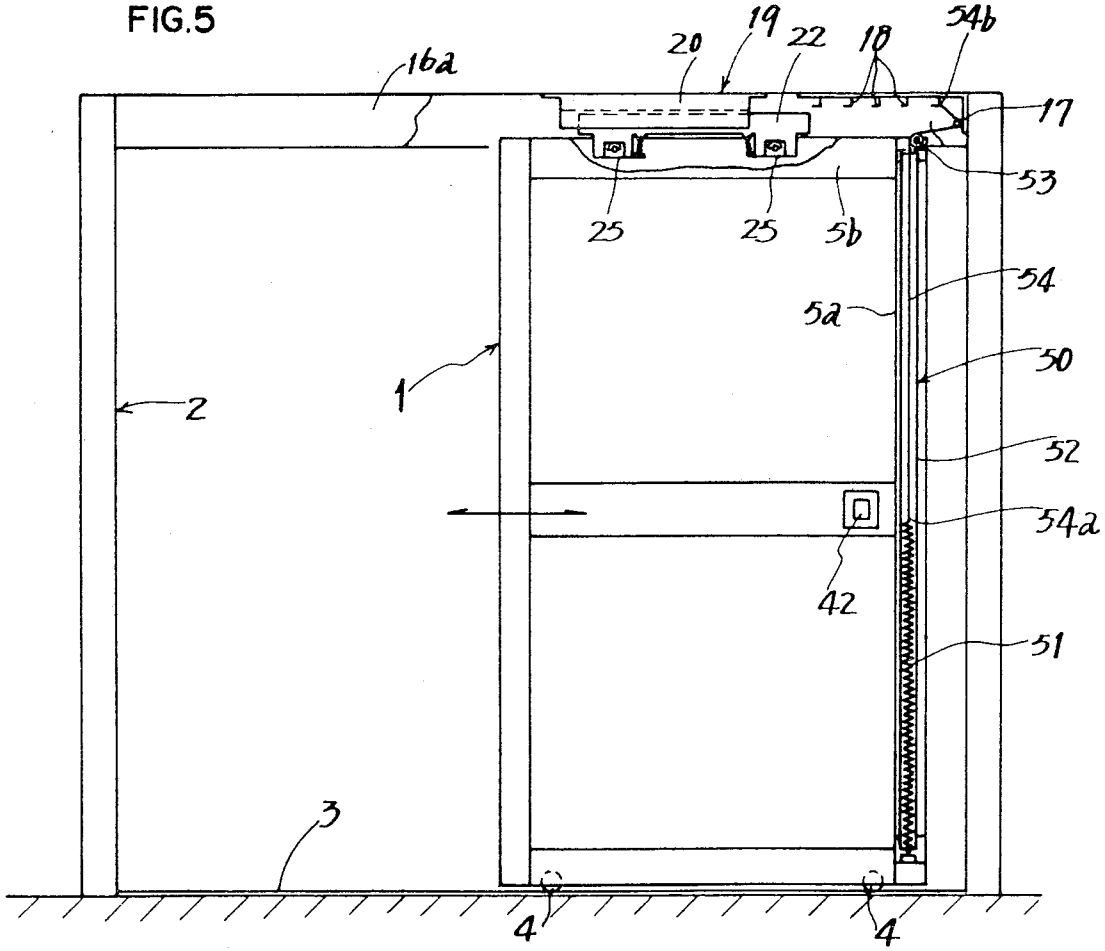
FIG. 5 is a front elevation of a modified embodiment of this invention.
Figure 6:
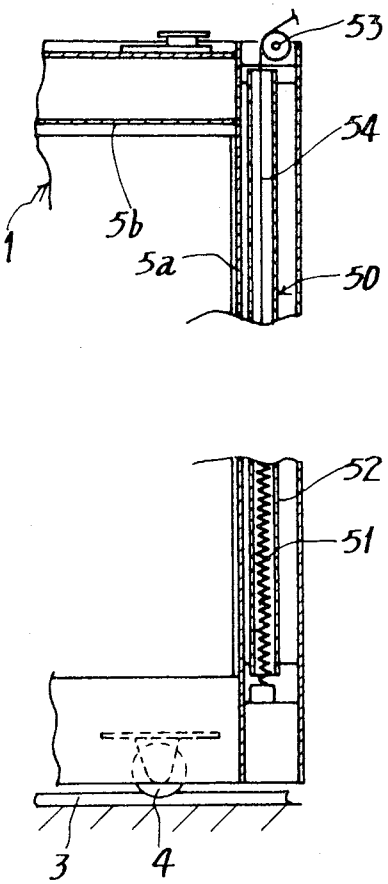
FIG. 6 is a partially cutaway enlarged longitudinal sectional view of a part of the sliding door including the driving means of the embodiment shown in FIG. 5; and, FIG. 7 is an elevation of another modified embodiment of this invention.

FIGS. 5 and 6 show a modified embodiment of this invention in which the same reference numbers are applied to the elements of the same kind as those in FIGS. 1 through 4. In this modified embodiment, the driving means 50 is different from the previously described driving means 6. This driving means 50 is arranged within the stile 5*a* as shown in FIG. 6 and comprises a tension spring 51 whose one end is fixed to the lower part of the stile 5*a*, a cylinder 52 enclosing the tension spring 51, a guide wheel 53 provided on the top end of the stile 5*a*, and a wire 54 having one end 54*a* connected to the other end of the tension spring 51 and the other end 54*b* caught by the hook 18 through the guide wheel 53 and the intermediate fitting 17 provided on the one end of the top frame 16*a* of the outer framework. Fixation of the one end of tension spring 51 to the bottom of the cylinder 52 fixed to the stile 5*a*, instead of that to the lower part of the stile 5*a*, makes for easy setting operation. On the other hand, the cylinder 52 may be omitted in some cases if needed. According to this driving means 50, the length of stretch of the tension spring 51 is equal to the stroke of the sliding door 1 and longer than that in the previous one because no block is employed, however, the sectional area occupied by this means is reduced.

Figure 7:
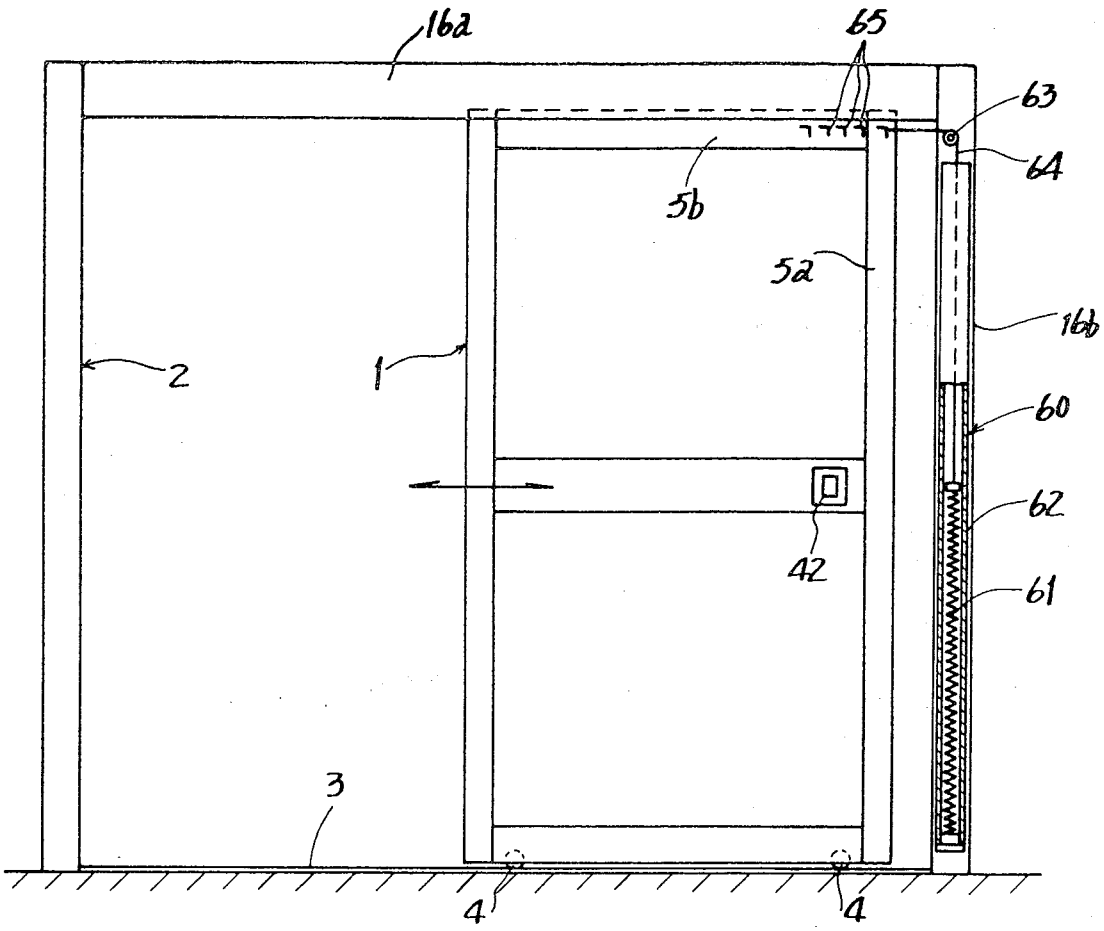

FIG. 7 shows another modified embodiment of this invention, in which what is different from the previously described embodiments is the fact that no braking means such as that shown at 19 in FIGS. 1, 4 and 5 is provided, the construction of driving means 60 is different from the other ones, and the place to which the driving means is fixed is not the inside of stile 5*a* of the sliding door 1 but the outside of the vertical frame 16*b* of the outer framework 2. The driving means 60 is approximately the same as driving means 50 shown in FIGS. 5 and 6 in structure and consists of a tension spring 61 arranged outside the vertical frame 16*b*, a cylinder 62 enclosing said tension spring 61 whose one end is fixed to the bottom of this cylinder, a guide wheel 63 arranged on the upper part of the vertical frame 16*b*, and a wire having one end 64*a* connected to the other end of the tension spring 61 and the other end 64*b* caught by one of a plurality of hooks 65 provided on the top rail 5*b* of the sliding door 1 through the guide wheel 63. This driving means 60 may be installed inside the vertical frame 16*b* of outer framework and, in this case, the one end of tension spring 61 may be fixed to the bottom end of said frame 16*b* without providing a cylinder 62.

This invention is not limited to the embodiment shown in FIGS. 1 through 4 and other modified ones shown in FIGS. 5, 6 and 7 but only as defined by the claims. Various modifications of every component and combined applications thereof other than those described as modified embodiments referring to the drawings are included within the scope of this invention.

What is claimed is:

1. A semiautomatic sliding door device with a tension spring comprising:

a sliding door, a frame structure for slidably guiding the door between the open position and closed position of the door, a coiled tension spring carried by one of two elements consisting of the sliding door and the frame structure for urging the door toward the closed position, the spring having its one end fixed to said one of the two elements and its other end connected through a wire to the other of the two elements, guide means carried at least by said one of the two elements for guiding the wire, and braking means comprising a braking plate of copper or aluminum fixed to the sliding door and a braking magnet unit fixed to the upper frame of the frame structure and having a pair of magnetic surfaces opposed to each other with a clearance and provided by one or two permanent magnets, the magnetic surfaces having an identical row of plural magnetic poles alternately inversely magnetized, every pair of opposed magnetic poles on the magnetic surfaces having opposite polarities, and the braking plate being adapted to pass through the clearance adjacent the closed position of the sliding door.

2. A device as defined in claim 1 wherein the working position of the braking plate in the clearance is adjustable in vertical direction.

3. A semiautomatic sliding door device as defined in claim 1 wherein the tension spring is arranged inside a stile of the sliding door with its one end fixed to the stile and its other end caught through the wire by hook means provided on the top frame of the frame structure, and the guide means is a guide wheel provided on the upper end of the stile.

4. a semiautomatic sliding door device as defined in claim 15 wherein the tension spring is arranged inside a vertical frame of the frame structure with its one end fixed to the vertical frame and its other end caught through the wire by hook means provided on the upper rail of the sliding door, and the guide means is a guide wheel provided on the upper end portion of said vertical frame of the frame structure.

5. A semiautomatic sliding door device as defined in claim 1 wherein the tension spring is enclosed by a cylinder arranged on the outer surface of the frame structure with its one end fixed to one end of the cylinder and its other end caught through the wire by hook means provided on the upper rail of the sliding door, and the guide means is a guide wheel provided on the upper end portion of said vertical frame of the frame structure.

6. A semiautomatic sliding door device as defined in claims 3, 4 or 5 wherein the hook means comprises a plurality of hooks whose positions are different from each other so as to make it possible to optionally select the position at which one end of the wire farther from said other end of the spring is arrested by the hook means.

7. A semiautomatic sliding door device as defined in claim 1 further comprising a cylinder for enclosing the spring.

8. A semiautomatic sliding door device as defined in claim 1 wherein said one end of the spring is attached to block means comprising at least one block, and the wire is reeved around the block means with its one end fixed to said one of the two elements and its other end connected to the other of the two elements through the guide means.

9. A semiautomatic sliding door device as defined in claim 15 wherein the tension spring is housed in a cylinder mountable on said one of the two elements and has its one end fixed to one end of the cylinder and its other end connected to a block movable in the cylinder, and the wire, with its one end fixed to the other end of the cylinder, is reeved around the block and extends out from the cylinder through a guide wheel provided at the other end of the cylinder to be connected to the other of the two elements.

10. A semiautomatic sliding door device as defined in claim 23 wherein connecting means is provided for connecting the spring to said one end of the cylinder or to the block in the form of an externally threaded member with which one end portion of the spring engages.

11. A semiautomatic sliding door device as defined in claim 1 wherein fixing means for fixing the braking plate to the sliding door is provided which comprises supporting means arranged inside the top rail of the sliding door and having a central hollow space to receive the braking plate in partially inserted condition, the supporting means supporting the braking plate vertically displaceably, and a cam shaft supported in the supporting means rotatably about its horizontal axis and provided with a plurality of contact portions for contacting the braking plate from under, the distance between the horizontal axis and the respective contact portions being different.

12. A semiautomatic sliding door device as defined in claim 11 wherein the supporting means comprises a setting piece having said hollow space and a supporting piece supported by the setting piece horizontally movably in said hollow space and supporting the braking plate vertically movably, and an adjusting sleeve is provided which has its one end portion rotatably supported in the supporting piece and its remaining portion externally threaded for engagement with a horizontal threaded hole provided in the setting piece, the cam shaft fitting rotably in the adjusting sleeve.

13. A semiautomatic sliding door device as defined in claim 1 wherein fixing means for fixing the braking plate to the sliding door is provided which comprises a setting piece mounted inside the top rail of the sliding door and having a hollow space to receive the braking plate in partially inserted condition, a supporting piece positioned in the hollow space and comprising a pair of supporting plates for clamping therebetween the braking plate, a first supporting shaft extending from one of the supporting plates and fitted axially displaceably in a horizontal hole provided in the setting piece, and a second supporting shaft having its end portion rotatably retained in the other of the supporting plates and its remaining portion externally threaded for engagement with a horizontal threaded hole provided in the setting piece.

* * * * *